United States Patent [19]

Johnson, Jr.

[11] 4,356,646

[45] Nov. 2, 1982

[54] CARD HOLDER

[76] Inventor: Thomas A. Johnson, Jr., 859 Wabash, Carol Stream, Ill. 60187

[21] Appl. No.: 238,496

[22] Filed: Feb. 26, 1981

[51] Int. Cl.[3] ..... G09F 3/18; B41L 47/02

[52] U.S. Cl. ..... 40/16.4; 40/10 R; 40/17; 101/369

[58] Field of Search ..... 40/2.2, 10 R, 152.1, 40/16, 17, 18, 21 C, 20 R, 156, 158 R, 16.4, 158 B, 16.6, 158 A; 101/369, 269, 368

[56] References Cited

U.S. PATENT DOCUMENTS

| | | | |
|---|---|---|---|
| 35,431 | 6/1862 | Bailey | 40/17 |
| 83,915 | 11/1868 | Bramble et al. | 40/16.4 |
| 1,197,065 | 9/1916 | Sand | 40/17 |
| 3,029,537 | 4/1962 | Hopp et al. | 40/17 |
| 3,379,130 | 4/1968 | Korfmann | 101/369 |
| 4,048,737 | 9/1977 | McDermott | 40/2.2 |

*Primary Examiner*—Gene Mancene
*Assistant Examiner*—Michael J. Foycik

[57] ABSTRACT

A card holder for housing, for example, plastic patient identification cards which have on them vital patient information and tabbys, i.e., tabs which have on them room or bed numbers and which normally are adhesively affixed to the card holder is fabricated of metal, preferably stainless steel, and is of a size substantially corresponding to the size of the identification card to be removably supported by it. Being of metal, the useful life of the card holder is far greater than those of plastic. The card holder has parallel side edges, each of which has at least one and preferably two upstanding stops integrally formed therewith, which stops have a height substantially corresponding to the thickness of the identification card. These upstanding stops prevent lateral movement of the identification card with respect to the card holder. In addition, a generally L-shaped retainer is integrally formed with each of the parallel top and bottom edges of the card holder, and these L-shaped retainers form slots for receiving therein the upper and lower edges of the identification card to effectively secure the identification card in and affixed against movement to the card holder. A tab portion also is integrally formed with the top edge of the card holder, and indicia such as a room or bed number is permanently embossed on this tab portion, thus eliminating the need for adhesively affixed tabbys and the like. Preferably a support tab is fixedly secured beneath the tab portion on its backside to support the tab portion during imprinting, so that a clear print of the embossed indicia is provided. A semi-circular cut-out in at least one side edge of the card holder is provided to assist in removing the identification card from the card holder.

1 Claim, 7 Drawing Figures

CARD HOLDER

BACKGROUND AND OBJECTS OF THE INVENTION

This invention relates to an improved card holder. More particularly, it relates to an improved metal card holder to replace the plastic card holders presently used by hospitals to house a plastic patient identification card and tabby.

An assembly as described above, i.e., the card holder, plastic patient identification card and tabby, is used in an imprinter, and is the overall major device for hospitals to record and bill patient's for services and medication administered while in the hospital. The plastic patient identification card is embossed with vital patient information, while the tabby is embossed with a room or bed number and affixed to the card holder. The plastic patient identification card is placed in the card holder carrying the room or bed number in which the patient is located, and obviously, can be removed and replaced in an appropriately numbered card holder if the patient is moved to another room or bed.

The card holder, or room jacket, with the tabby are designed to eliminate the need for hospitals to emboss a room or bed number on the actual patient identification card. When the room or bed number is embossed on the patient identification card, the card has to be re-made if the patient is moved from one room or bed to another. With the provision of the room jacket, the patient identification card is simply removed and inserted in the appropriately numbered from jacket.

Card holders of this type, or room jackets as they are commonly called, presently are available, however, most are fabricated of plastic and have limited useful lives of approximately 2–6 months, depending upon the extent of use. One such card holder which is used extensively is disclosed in U.S. Pat. No. 3,379,130. These plastic card holders, while used extensively, all suffer various defects including the fact that they attract dirt and oils from being handled, since they are fabricated of plastic and contain static electricity. In addition, these card holders normally are very thin and therefore relatively flimsy. They therefore are easily bent out of shape, and once they are, they must be discarded and replaced. When the plastic is folded, as in the case of the card holder of the above-mentioned U.S. Pat. No. 3,379,130, the plastic tends to break after a limited period of use, rendering the card holder useless. In many cases, the construction of the card holder limits the number of lines of patient information which can be embossed on the patient identification card.

Accordingly, it is an object of the present invention to provide a new and improved card holder.

More particularly, it is an object to provide an improved metal card holder to replace the plastic card holders generally used by hospitals to house a plastic patient identification card and tabby.

The above and other objectives are accomplished with the card holder of the present invention which is fabricated of metal, preferably stainless steel, and is of a size substantially corresponding to the size of the identification card to be removably supported by it. Being of metal, the useful life of the card holder is far greater than those of plastic. The card holder has parallel side edges, each of which has at least one and preferably two upstanding stops integrally formed therewith, which stops have a height substantially corresponding to the thickness of the identification card. These upstanding stops prevent lateral movement of the identification card with respect to the card holder. In addition a generally L-shaped retainer is integrally formed with each of the parallel top and bottom edges of the card holder, and these L-shaped retainers form slots for receiving therein the upper and lower edges of the identification card to effectively secure the identification card in and affixed against movement to the card holder. A tab portion also is integrally formed with the top edge of the card holder, and indicia such as a room or bed number is permanently embossed on this tab portion, thus eliminating the need for adhesively affixed tabbys and the like. Preferably a support tab is fixedly secured beneath the tab portion on its backside to support the tab portion during imprinting, so that a clear print of the embossed indicia is provided. A semi-circular cut-out in at least one side edge of the card holder is provided to assist in removing the identification card from the card holder.

DESCRIPTION OF THE PREFERRED EMBODIMENT

Figure 1:
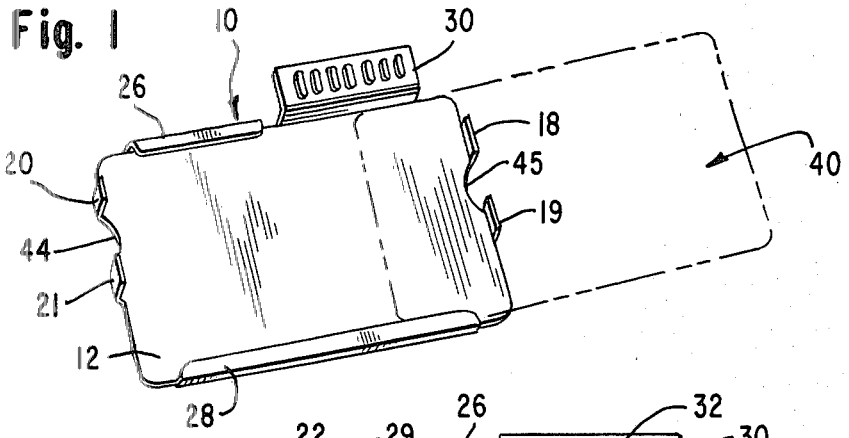
FIG. 1 is a top perspective view of the card holder, generally illustrating the manner in which a plastic identification card is inserted and retained therein.
Figure 2:
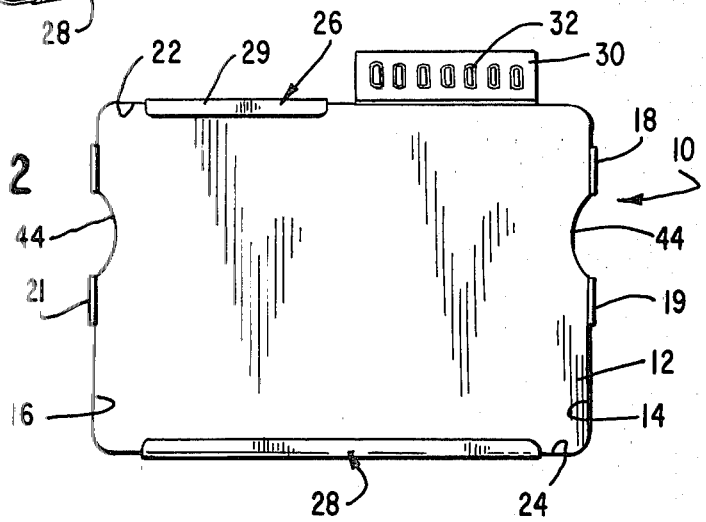
FIG. 2 is a top plan view of the card holder.

Referring now to the drawing, a card holder 10 is illustrated for retaining a plastic identification card 40. The card holder 10 is fabricated of a durable lightweight metal that will not rust, corrode, tarnish, or show any signs of oxidation. A preferred metal is stainless steel, however, other metals such as aluminum, tin and the like can be used. The metal may be of a natural finish, or colored to denote areas of application.

The card holder 10 has a back wall 12 which substantially corresponds to the size of the plastic identification card 40. The latter generally are of two standard sizes, designated CR50 ($1\text{-}23/32\times3\frac{1}{2}$) and CR80 ($2\frac{1}{8}\times3\frac{3}{8}$), however, the card holder 10 can be sized to other size plastic identification cards as well. The card holder 10 has parallel side edges 14 and 16, and projecting upwardly from the side edges 14 and 16 are pairs of upstanding stops 18, 19 and 20, 21, respectively. The height of these stops 18–21 corresponds to the thickness of the plastic identification cards, for reasons which will be apparent from the description below. These upstanding stops 18–21 effectively prevent lateral movement or shifting of the plastic identification card in the card holder 10.

Figure 3:
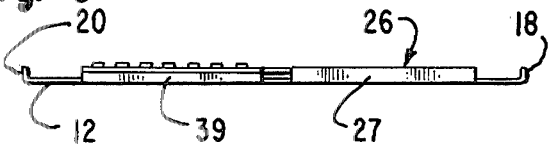
FIG. 3 is a top edge plan view of the card holder.

The card holder 10 also has parallel top and bottom edges 22 and 24. A generally L-shaped retainer 26 is integrally formed with the top edge 22, and extends along substantially one-half the length of the top edge 22, from the left hand side thereof, as illustrated. The L-shaped retainer 26 has an upstanding leg 27 (FIG. 3) and a leg 29 which extends parallel to and overlies the back wall 12, so as to provide a slot 31 having a spacing substantially corresponding to the thickness of the plastic identification card 40 for receiving therein the edge of the card. A similar L-shaped retainer 28 is integrally formed with the bottom edge 26, and extends along substantially the entire length of the bottom edge. The L-shaped retainer 28 also has an upstanding leg 33 and a leg 35 which extends parallel to and overlies the back wall 12, so as to provide a slot 37 having a spacing substantially corresponding to the thickness of the plastic identification card 40 for receiving therein the edge of the card. The L-shaped retainers 26 and 28 cooperatively function to contain the plastic identification card 40 in the card holder 10.

Figure 4:
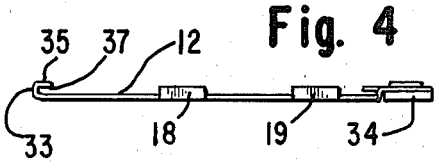
FIG. 4 is a right side edge plan view of the card holder.
Figure 5:
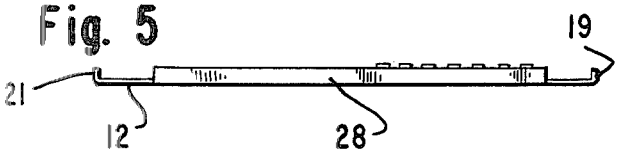
FIG. 5 is a bottom edge plan view of the card holder.
Figure 6:
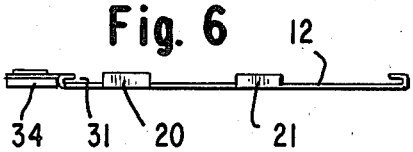
FIG. 6 is a left side edge plan view of the card holder.
Figure 7:
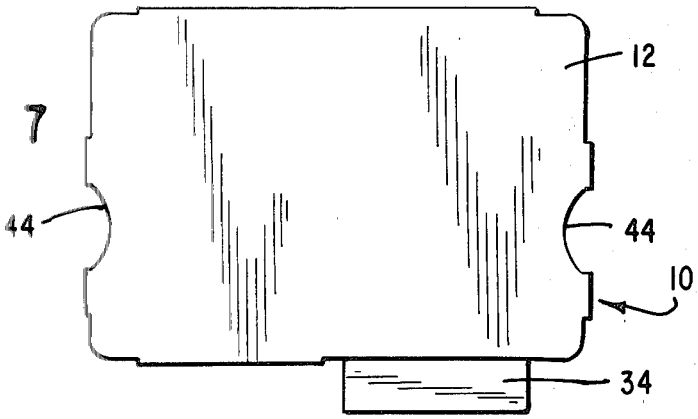
FIG. 7 is a bottom plan view of the card holder.

A generally rectangular-shaped tab portion 30 also is integrally formed along the top edge 22 adjacent to the L-shaped retainer 26. The tab portion 30 is formed with an upstanding wall 39 and a top wall 41 which extends parallel to and upwardly from the back wall 12 in a plane substantially corresponding to the plane of the top surface of the plastic identification card 40 when the latter is secured within the card holder 10. Indicia 32, such as, for example, a hospital room number, is permanently embossed on the tab portion 30. In order to provide support for the tab portion 30 when the card holder 10, including a plastic identification card 40, is placed in an imprinter and used to stamp an invoice or the like, a support tab 34 preferably and advantageously is secured to the back of the tab portion 30, as can be best seen in FIGS. 4 and 6. This support tab 34 prevents the tab portion 30 from bending of flexing, so that a clear imprint of the indicia 32 is obtained.

A small semi-circular shaped cutout 44 is formed in at least one of the side edges 14 and 16 of the card holder 10 to assist in removing a plastic identification card 40. The cutout(s) 44 permit the edge(s) of the card to be flexed upwardly to clear the upstanding stops 18, 19 or 20, 21 to remove the card from the card holder 10.

In use, as indicated above, indicia 32 such as a hospital room or bed number if permanently embossed on the tab portion 30 of the card holder 10. Accordingly, since this indicia 32 is permanently embossed on an integral portion of the card holder 10, this information cannot be displaced or lost, as in those cases where a tabby or other like means carrying such indicia is adhesively affixed to the card holder.

A plastic identification card, such as the card 40, is inserted within the card holder 10 by simply slidably inserting the top and bottom edges of the card in the slots 31 and 37 formed by the L-shaped retainers 26 and 28, as illustrated in FIG. 1. The card is slidably inserted in this fashion, until its one edge abuts against the upstanding stops 20 and 21. The opposite edge of the card then is released, and the resiliency of the plastic card snaps it in place, with this opposite edge abutted against the upstanding stops 18 and 19. The plastic identification card 40 thus is retained against lateral movement with respect to the card holder 10 by the upstanding stops 18, 19 and 20, 21, and is retained against transverse movement and is affixed to the card holder 10 by the L-shaped retainers 26 and 28. The upstanding wall 39 of the tab portion 30 also functions in conjunction with the upstanding stops 18–21 and the L-shaped retainers 26 and 28 to secure the plastic identification card against movement with respect to the card holder.

The edges of the plastic identification card are disposed beneath the legs 28 and 29 of the L-shaped retainers 26 and 28, but it may be noted that the length of these legs 28 and 29 are only sufficiently long to overlap and secure these edges and yet sufficiently short so as to not interfere to any great extent with the area of the plastic identification card which can be embossed on the plastic identification card, then normally can be embossed thereon when used with plastic card holders.

When used to imprint a document, the card holder 10 with its retained plastic identification card are placed as an assembly in an imprinter, and the latter operated in conventional fashion. Since the height of the upstanding stops substantially correspond to the thick of the plastic identification card, they do not interfere with the operation of the imprinter. Furthermore, since the embossed surface of the plastic identification card and of the tab portion 30 are in the same horizontal plane, the information embossed on both the card and the tab portion is clearly imprinted on a document. As indicated above, the tab support 34 which is fixedly secured to the backside of the tab portion 30 prevents the latter from flexing or bending during imprinting operations. Again, since the legs 28 and 29 of the L-shaped retainers 26 and 28 are short in length, very little of the document is or may be obscured by the imprinting operation. Further still, being of metal and the described construction, the card holder 10 is capable of withstanding considerable abuse and use, thus its useful life is far greater than plastic card holders.

The plastic identification card can be easily and simply removed from the card holder, by simply applying finger force against its edge at the finger cutout 44 in the edge of the card holder 10. The edge of the plastic identification card only is sufficiently raised to permit it to be grasped between the fingers to pull it free. In this respect, it may be further noted that no special attachment means, such as punched holes in the card, which greatly increase the cost of the cards, is required to secure the card to the card holder.

Accordingly, from the above description, it can be seen that an improved card holder is provided. Furthermore, various changes in its construction can be made without departing from the spirit of the invention. For example, the tab portion 30, while illustrated as being to the right of the L-shaped retainer 26, can as well be located at its left. It likewise can be disposed centrally of the card holder, in which case it may be advantageous to provide a smaller L-shaped retainer on each of its opposite sides. Further still, in certain applications, it may be simply eliminated.

Now that the invention has been described, what is claimed as new and desired to be secured by Letters Patent is:

1. A card holder for retaining a plastic identification card, said card holder being fabricated of metal and having a back wall of a size substantially corresponding to said card, said card holder having parallel side edges each having integrally formed therewith at least one upstanding stop which is of a height substantially corresponding to the thickness of said card for receiving therebetween the opposite side edges of said card for preventing lateral movement of said card with respect to said card holder, said card holder further having parallel top and bottom edges each having integrally formed therewith along at least a portion of the length thereof a generally L-shaped retainer having a leg overlying said back wall and forming therewith a slot for receiving therein the opposite top and bottom edges of said card for securing said card in said card holder, the length of the legs of said L-shaped retainers being sufficiently long to overlap and secure the edges of a card and sufficiently short so as to not interfere to any great extent with the area of the card which can be embossed, said top edge further having integrally formed therewith a tab portion extending outwardly of said card holder in a parallel plane which is disposed at a height above said back wall substantially corresponding to the thickness of said card, an edge of said tab portion functioning in conjunction with said L-shaped retainers to secure a card against transverse movement with respect to said card holder, a tab support on the backside of said tab portion, for preventing flexing or bending of said tab portion during use of said card holder, and a cutout in at least one side edge of said card holder, for permitting a finger to be pressed against said plastic identification card to raise its edge to permit it to be removed from said card holder.

* * * * *